US007920805B2

(12) United States Patent
Bellino et al.

(10) Patent No.: US 7,920,805 B2
(45) Date of Patent: Apr. 5, 2011

(54) PHOTOCONDUCTOR FORMULATION CONTAINING BORON NITRIDE

(75) Inventors: Mark Thomas Bellino, Loveland, CO (US); Weimei Luo, Louisville, CO (US); Michael George Sloan, Longmont, CO (US); Tanya Yvonne Thames, Aurora, CO (US)

(73) Assignee: Lexmark International, Inc., Lexington, KY (US)

( * ) Notice: Subject to any disclaimer, the term of this patent is extended or adjusted under 35 U.S.C. 154(b) by 391 days.

(21) Appl. No.: 11/782,138

(22) Filed: Jul. 24, 2007

(65) Prior Publication Data

US 2009/0029275 A1 Jan. 29, 2009

(51) Int. Cl.
*G03G 5/02* (2006.01)
*G03G 15/02* (2006.01)

(52) U.S. Cl. ..... 399/111; 430/58.05; 430/58.65; 430/110.1; 430/110.3

(58) Field of Classification Search ..... 399/111; 430/58.05, 58.65, 110.1, 110.3
See application file for complete search history.

(56) References Cited

U.S. PATENT DOCUMENTS

| | | | | |
|---|---|---|---|---|
| 6,326,112 | B1 | 12/2001 | Tamura et al. | |
| 7,160,658 | B2 | 1/2007 | Suzuki et al. | |
| 2003/0077531 | A1 * | 4/2003 | Suzuki et al. | 430/66 |
| 2003/0113642 | A1 * | 6/2003 | Kami et al. | 430/57.2 |
| 2003/0147670 | A1 * | 8/2003 | Asano et al. | 399/223 |
| 2004/0126689 | A1 * | 7/2004 | Tamoto et al. | 430/66 |
| 2005/0008957 | A1 * | 1/2005 | Ikegami et al. | 430/56 |
| 2005/0281726 | A1 * | 12/2005 | Paine, Jr. | 423/277 |
| 2006/0093930 | A1 | 5/2006 | Nonaka et al. | |
| 2006/0216084 | A1 * | 9/2006 | Kojima et al. | 399/350 |
| 2007/0042284 | A1 * | 2/2007 | Takada et al. | 430/109.1 |

OTHER PUBLICATIONS

Abstract of JP 62235358 Oct. 1987.*

* cited by examiner

*Primary Examiner* — Hoa V Le

(57) ABSTRACT

The present disclosure relates to incorporation of boron nitride in the charge transport layer of a photoconductor. The boron nitride may have an aspect ratio of greater than 1.0, a D50 mean particle size of less than about 10.0 μm and be present at about 5.0% (wt) or less in the charge transport layer. The cartridge may also include toner particles wherein the toner particles have a size range of about 1-25 μm and an average degree of circularity of about 0.90-1.0. The photoconductor containing boron nitride when used in an electrophotographic printer may then provide acceptable dark decay and/or photoinduced decay (PID) curves relative to photoconductors that do not contain boron nitride along with improved resistance to toner filming.

17 Claims, 4 Drawing Sheets

PHOTOCONDUCTOR FORMULATION CONTAINING BORON NITRIDE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates to photoconductor formulations and, in particular, charge transport formulations including boron nitride additives which may mitigate filming on a photoconductor surface in the presence of relatively small diameter spherical toner.

2. Description of the Related Art

In an image forming device, such as a printer, copier, fax, all-in-one device or multi-functional device, a photoconductor may be used to transfer toner onto a sheet of media. The photoconductor may be charged by a charge generation device and then selectively discharged to form a latent image on the photoconductor. Toner, or other image forming materials, may then be selectively transferred onto the photoconductor to form an image thereon, which may then be transferred to a sheet of media. The transferred toner may then be fused to the sheet of media by a device which may apply heat and/or pressure to the toner on the media.

SUMMARY OF THE INVENTION

In a first exemplary embodiment the present disclosure relates to a printer cartridge comprising a photoconductor containing a support structure, a charge generation layer disposed at least partially over the support structure and a charge transport layer. Boron nitride may be dispersed in the charge transport layer, wherein the boron nitride has an aspect ratio of greater than 1.0, a D50 mean particle size of less than about 10.0 μm, and is present at about 5.0% (wt) or less in the charge transport layer. The cartridge may also include toner particles wherein the toner particles have a size range of about 1-25 μm and an average degree of circularity of about 0.90-1.0. The photoconductor containing boron nitride when used in an electrophotographic printer may then provide a dark decay ($DD_{BN}$) that is equal to about (0.7-1.3)(DD), wherein DD represents the dark decay of the photoconductive element in the absence of boron nitride and a photoinduced decay residual potential at 0.7 uJ/cm$^2$ that is within about +/−15% of the residual potential of the photoconductor in the absence of boron nitride.

In a second exemplary embodiment the present disclosure again relates to a printer cartridge comprising a photoconductor containing a support structure, a charge generation layer disposed at least partially over the support structure and a charge transport layer containing a polycarbonate binder and an aryl amine compound. The charge transport layer may be present at a thickness of about 20-30 microns. Boron nitride may then be dispersed in the charge transport layer, wherein the boron nitride has an aspect ratio of greater than 1.0, a D50 mean particle size of less than about 8.0 μm, and is present at about 5.0% (wt) or less in the charge transport layer. The cartridge may then include toner particles wherein the toner particles have a size range of about 1-25 μm and an average degree of circularity of about 0.90-1.0. The photoconductor containing boron nitride when used in an electrophotographic printer may then provide a dark decay ($DD_{BN}$) that is equal to about (0.7-1.3)(DD), wherein DD represents the dark decay of the photoconductive element in the absence of boron nitride and a photoinduced decay residual potential at 0.7 uJ/cm$^2$ that is within about +/−15% of the residual potential of the photoconductor in the absence of boron nitride.

In a third exemplary embodiment the present disclosure relates to a method for forming a photoconductor containing a support structure, a charge generation layer and a charge transport layer. The method includes combining a binder and a charge generation compound and coating a portion of the support structure and forming a charge generation layer having a thickness of less than or equal to about 5.0 microns. This may then be followed by combining a binder and a charge transport compound and boron nitride and coating a portion of the charge generation layer to form a charge transport layer at a thickness of less than or equal to about 35 microns. The boron nitride may have an aspect ratio of greater than 1.0, a D50 mean particle size of less than about 10.0 μm, and be present at about 5.0% (wt) or less in the charge transport composition. The photoconductor containing boron nitride when used in an electrophotographic printer may then provide a dark decay ($DD_{BN}$) that is equal to about (0.7-1.3)(DD), wherein DD represents the dark decay of the photoconductor in the absence of boron nitride and a photoinduced decay residual potential at 0.7 uJ/cm$^2$ that is within about +/−15% of the residual potential of the photoconductor in the absence of boron nitride.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
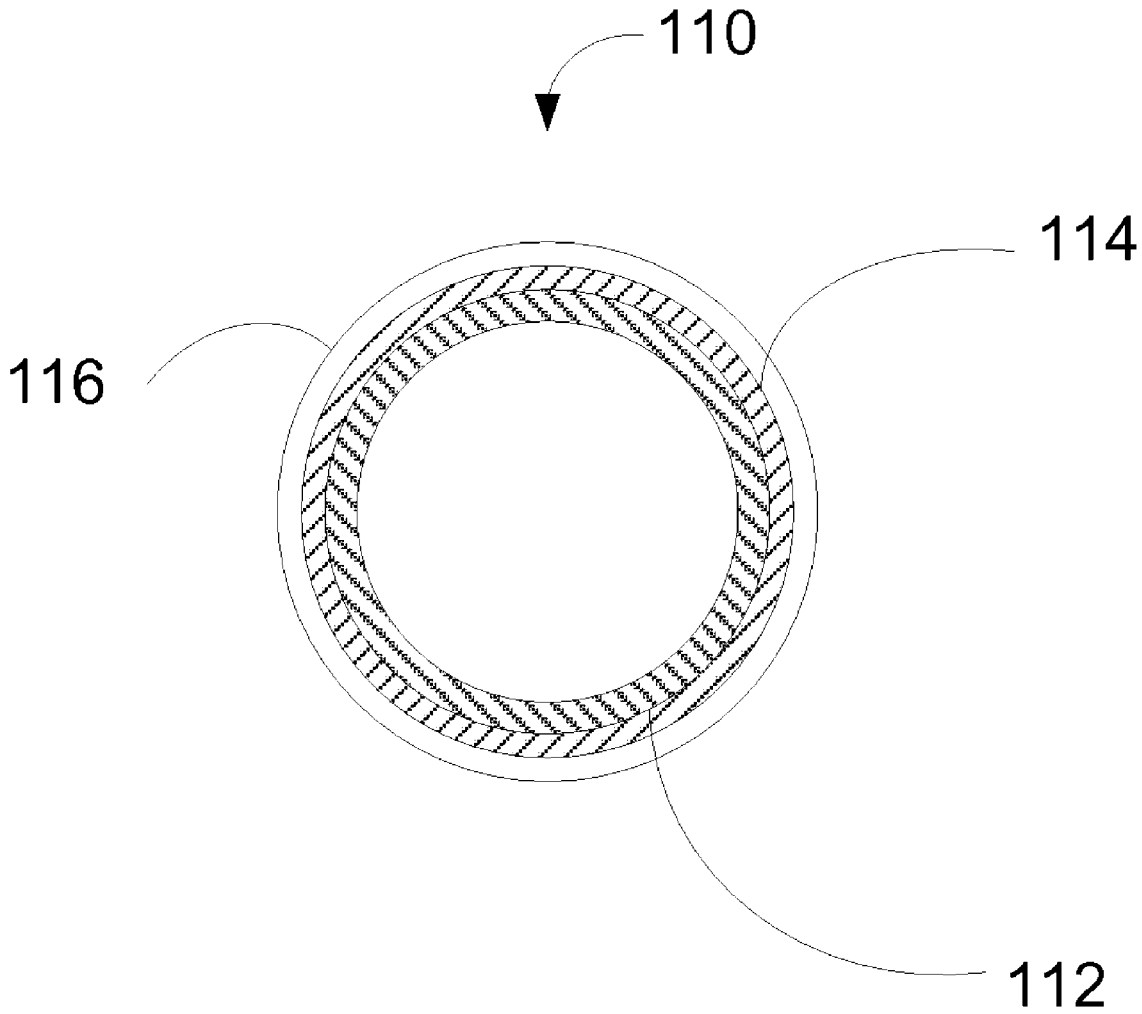
FIG. 1 is a cross-sectional view of an exemplary photoconductor.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The present invention relates to photoconductor formulations and, in particular, charge transport formulations including boron nitride additives. A cross sectional view of an exemplary photoconductive element is illustrated in FIG. 1. The photoconductor 110 may include a support element 112 including a charge generation layer 114 and a charge transport layer 116 formed over the support element 112. Additional layers may be included between the support element 112, the charge generation layer 114 and the charge transport layer 116, including adhesive and/or coating layers. In addition, a coating layer may be formed over the outer layer of the photoconductor 110.

The support element 112 is illustrated in FIG. 1 as generally cylindrical. However the support element may assume other shapes or may be formed into a belt. It should also be appreciated that the support element may extend axially, such that the support element defines a length. In an exemplary embodiment, the support element may be formed from a conductive material, such as aluminum, iron, copper, gold, silver, etc. as well as alloys thereof. In addition the support element surfaces may be treated, such as by anodizing the support and/or sealing the support. In a further embodiment, the support element may be formed from a polymeric material and coated with a conductive coating. Such coatings may include those materials mentioned above.

The charge generation layer 114 may include a binder and a charge generation compound. A charge generation compound may be understood as any compound that may generate a charge carrier in response to light. The binder may include, e.g., poly(vinyl butyral), poly(methyl phenyl) siloxane, poly(hydroxystyrene) and combinations thereof. The charge generation compound may specifically be in the form of a pigment. The pigment may be dispersed uniformly through the charge generation composition. Exemplary charge generation compounds may include phthalocyanines, such as type I and IV titanyl phthalocyanine (TiOPC) and combinations thereof.

In one exemplary embodiment the binder and charge generation compound may be dispersed with one or more solvents such as 2-butanone or cyclohexane. The dispersion may then be applied onto at least a portion of the support element surface via various coating or spray techniques. The charge generation composition may be formed into a layer of less than or equal to about 5 microns (μm) in thickness. The thickness of the layer may therefore be in the range of about 0.01 to 5 μm, including all values and increments therein, such as 0.2 to 0.3 μm, etc.

The charge transport layer 116 may also include a binder and a charge transport compound. A charge transport compound may be understood as any compound that may contribute to surface charge retention in the dark and to charge transport under light exposure. The binder may include, for example, a polycarbonate resin, such as polycarbonate Z. An exemplary charge transport compound may include, for example, an aryl amine (an aromatic ring attached to a nitrogen atom) such as N,N'-bis(3-methylphenyl)-N,N'-diphenylbenzidine ($C_{38}H_{32}N_2$). In addition to the binder and charge transport compound, the charge transport composition may include an additive. Such additive may include antioxidants.

In addition to the above, an additive, such as boron nitride (BN), may now be directly incorporated and/or dispersed within the charge transport layer. The incorporation of boron nitride within the charge transport layer has now been shown to have particular utility in connection with the ability to reduce the relative amount of filming present on the photoconductor which reduction in the amount of filming may also be achieved while maintaining certain photoelectrical characteristics (as explained more fully below). It is also worth noting that such reduction in filming while maintaining photoelectric characteristics may be specifically achieved in connection with the use of relatively small diameter and relatively spherical toner compositions.

The boron nitride that may be employed herein may be in platelet form, which is reference to a three-dimensional shape wherein one dimension (e.g. thickness) is less than the corresponding length and width. Platelets may therefore be understand herein as particles having an aspect ratio (length/thickness ratio) of greater than 1.0, e.g., an aspect ratio of about 5-100, including all values and increments therein. In addition, the boron nitride platelet particles herein may have a D50 mean particle size of less than about 10 μm. Reference to a D50 mean particle size is reference to the feature that 50% by weight of the particles have a diameter greater than the indicated value, and 50% of a diameter of less than the indicated value. More particularly, the boron nitride platelets herein may have a mean particle size (D50) of greater than or equal to 1.0 μm to about 8.0 microns (largest linear dimension) including all values and increments therein. In addition, the boron nitride particles may have a surface area of about 4-17 $m^2$/gram, including all values and increments therein. In accordance with the present disclosure, the boron nitride may be present at levels of up to about 5% by weight of the charge transport composition used to form the charge transport layer. Accordingly, the boron nitride may be present at levels between about 0.1-5.0%, including all values and increments therein.

In particular, it may be appreciated that as toner particles are reduced in diameter, such toner particles may tend to adhere to a photoconductor surface, in which case a toner film may be ultimately be formed on the surface of the photoconductor. Such filming may then lead to print defects, e.g., streaky prints, relatively light prints and/or blurry prints due to toner filming on a photoconductor surface. In addition, such defects may increase under circumstances where a given printer is exposed to relatively high temperature and a relatively humid environment.

The toner particles herein for which the above referenced filming may now be reduced due to the presence of boron nitride may include those prepared by chemical methods, and in particular toner particles prepared via an emulsion aggregation procedure, which generally provides resin, colorant and other additives. The toner particles may have a size from about 1-25 μm, including all values and ranges therein. For example, the toner may have a particle size between 3 μm to about 15 μm, or between about 5 μm to about 10 μm. In addition, the toner may be configured such that at least about 80-99% of the particles fall within such size ranges, including all values and increments therein.

In addition, the toner particles herein may be generally spherical, which may be characterized by an average degree of circularity which may be provided by a Sysmex FP2100 Particle Analyzer. Accordingly, it may now be appreciated that the toner particles herein whose filming on the photoconductor may be controlled include toner particles having a size range of about 1-25 μm and/or an average degree of circularity of about 0.90-1.0, including all values and increments therein. Toner particles may therefore be considered to be relatively more spherical as the average degree of circularity approaches the value of 1.0. Average circularity may be calculated by dividing the circumferential length of a circle with the same area as a toner particle projected area with the circumferential length of the actual toner particle projected image.

Figure 2:
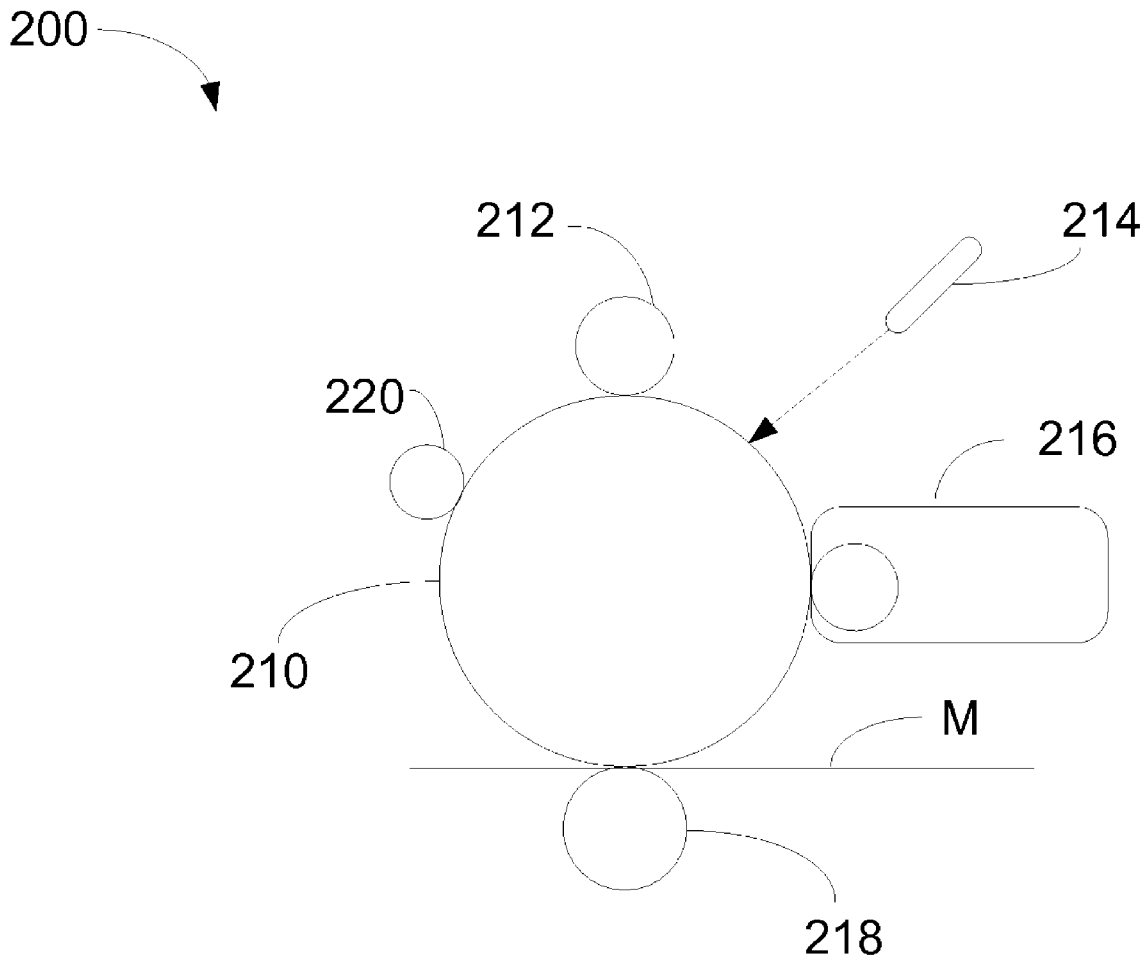
FIG. 2 is an illustration of an exemplary image forming device including a photoconductor.

An exemplary image forming device 200 is illustrated in FIG. 2 which includes a photoconductor 210. The photoconductor 310 may be charged by a charge roller 212 or a similar device. Then a laser or other device 214 may be used to selectively discharge portions of the photoconductor 310 to form a latent image thereon. A developer unit 216 may be provided to apply toner, or another image forming substance, to the photoconductor 210 forming a toner image thereon. The toner image may then be transferred to a sheet of media M. A transfer roller 218 may be provided to help transfer the toner to the sheet of media M. In addition a cleaning device 220, such as a cleaning roller may be provided to clean off excess toner and/or discharge the photoconductor.

As noted above, the level of boron nitride herein may be selected such that it does not adversely influence certain photoelectrical characteristics of the photoconductor. One such characteristic may include providing a photoconductor wherein the amount of boron nitride contained within the charge transport layer is selected such that the photoconductor may retain an applied voltage in the dark such that the photoconductor provides an acceptable charge-holding capability (i.e. acceptable dark-decay characteristics). This may first be understood with reference to FIG. 3, which provides an exemplary graph of potential of a photoconductor over time. The curve illustrates charging a photoconductor from a first potential $V_0$ to a desired potential $V_1$ over a first time period $t_1$. Once charged, the potential of the photoconductor may begin to decrease due to dark decay, i.e., the decay of the charge potential on the photoconductor, to a second potential $V_2$ over a time period $t_2$. Accordingly, it should be appreciated that the degree of dark decay should or desirably remain relatively small. The photoconductor may then be discharged at $V_3$ over a given period of time $t_3$, wherein the photoconductor may be discharged by, for example, a laser at 780 nm, causing the potential to decrease. It may therefore also be appreciated that the sensitivity to discharge may desirably be relatively high, wherein less energy or less time may be necessary to discharge the photoconductor surface.

Figure 3:
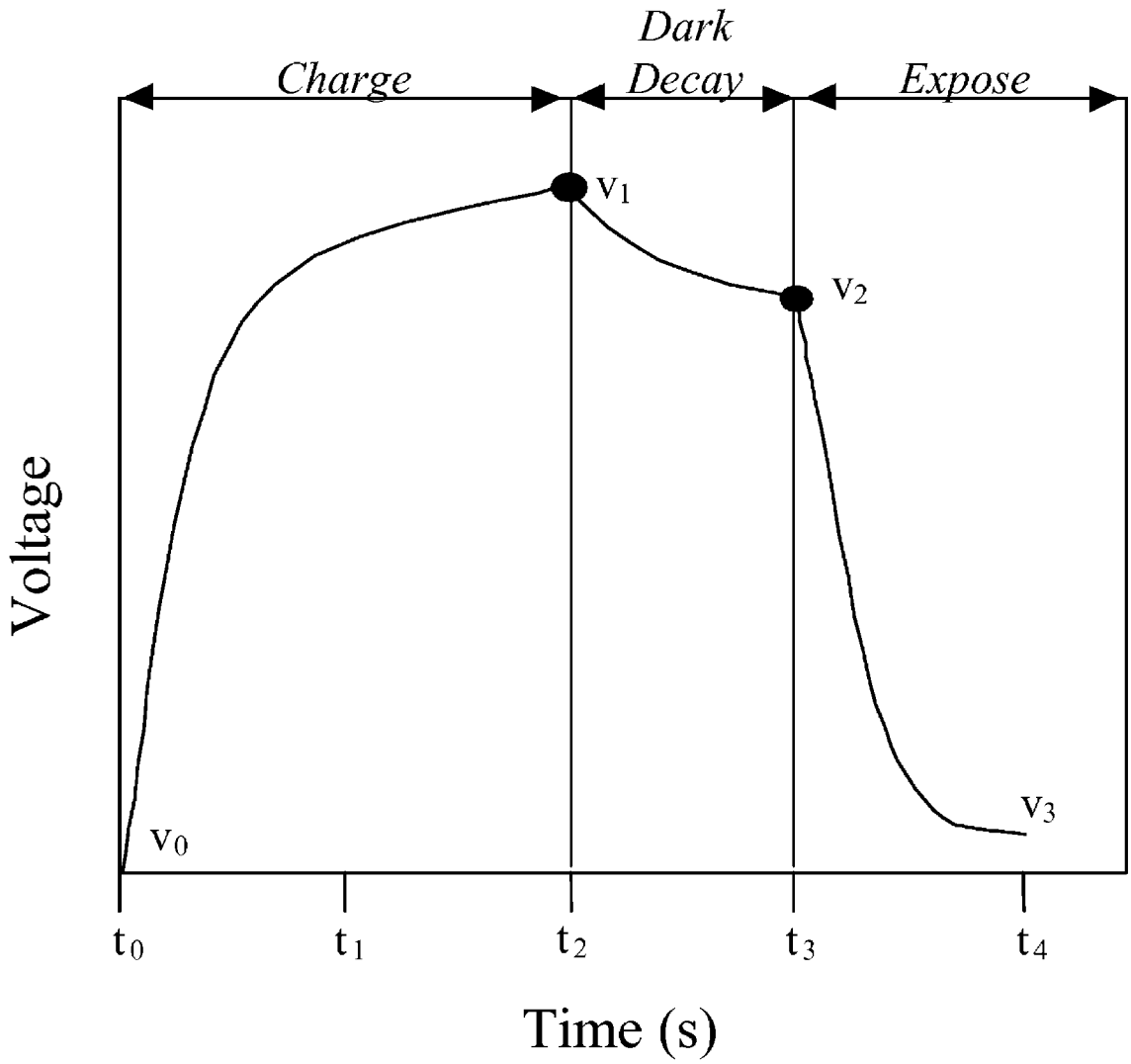
FIG. 3 is a graph of potential of a photoconductor over time.

Accordingly, and as will be elaborated upon with respect to the ensuing examples and data supplied in Tables 1 and 2, it has been recognized herein that the boron nitride in the charge transport layer may be selected in amounts which may not adversely influence the capability of the photoconductor to hold a charge in the dark suitable for a given electrophotographic printer. For example, a given photoconductor may indicate a dark decay (voltage drop) in the absence of any boron nitride (DD). More specifically, such dark decay may be understood as being equal to the difference in potential as between $V_1$ and $V_2$ over a given time period (e.g. $t_3-t_2$) as shown in FIG. 3. The boron nitride selected herein may therefore be incorporated into the charge transport layer of the photoconductor at desired levels such that the photoconductor may still hold its charge in the dark and filming may now be regulated. For example, the use of the boron nitride in a photoconductor herein has been found such that the dark decay of the photoconductor containing boron nitride ($DD_{BN}$) is equal to about +/−30% of the dark decay (DD) in the absence of BN. Accordingly, $DD_{BN}=(0.7-1.3)DD$.

Furthermore, the levels of boron nitride may be selected such that feature of photo-induced decay (PID) may be controlled to suitable levels. This is elaborated upon in more detail below in connection with FIG. 4 and the data produced from the accompanying examples. Photo-induced decay is a reference to the practice of charging the photoconductor surface and measuring the discharge voltage as a function of laser (780 nm) energy. Similar to the above, it has now been confirmed that the PID of the photoconductor containing boron nitride within the charge transport layer may again provide the above referenced filming resistance while indicating a PID that is substantially similar to a photoconductor that does not include any boron nitride. Accordingly, when incorporating boron nitride in the charge transport layer of a photoconductor, examples of which follow, it can be seen that one may incorporate a level of boron nitride that will provide, e.g., substantially the same discharge voltage. More specifically, the residual potential observed in the PID evaluation herein at 0.7 uJ/cm$^2$ for the photoconductor containing boron nitride in the charge transport layer when used in the presence of the above referenced toner may be within +/−15% or less of the residual potential of the photoconductor in the absence of boron nitride, including all values and increments therein. For example, the residual potential of the photoconductor containing boron nitride in the charge transport layer when used in the presence of the above referenced toner may be within +/−10% of the residual potential of the photoconductor in the absence of boron nitride.

In general, the charge transport composition containing the above referenced desired amount of boron nitride may be applied to the charge transport layer by coating utilizing a coating liquid in which the charge transport material may be dissolved or dispersed along with a binder resin and boron nitride in a suitable solvent (e.g., ketones such as methyl ethyl ketone, acetone, methyl isobutyl ketone, cyclahexanone; ethers such as dioxane, tetrahydrofuran and ethyl cellosolve; aromatic hydrocarbons such as toluene and xylene; halogenated hydrocarbons such as chlorobenzene and dichoromethane; and esters such as ethyl acetates and butyl acetate). Suitable coating methods include dipping, spraying, ring coating, roll coating, gravure coating, etc. The charge transport composition may be formed into a charge transport layer having a thickness of up to about 35 microns, including all values and increments therein. For example, the charge transport layer may have, e.g. a thickness of about 20-30 microns, or a thickness of about 22-29 microns, etc.

EXAMPLES

An image forming testing unit was provided including a charging unit, latent image forming devices, developer units, a transfer device and cleaner units. Sample photoconductors are mounted in the testing device. The photoconductor surfaces may be negatively charged using a charging roller. A laser source, having a wavelength of 780 nm then selectively discharges the photoconductors to form a latent image on the photoconductors corresponding to a color component of the desired image to be printed, i.e., CMYK (cyan, magenta, yellow and black) components.

Toner of a given color, i.e., C, M, Y or K, is added to the photoconductors via developing units which individually include a developing roller. The toner is then transferred from the photoconductors to an intermediate transfer belt using an electrostatic transfer method. The photoconductors are then exposed to a cleaning device, which individually include a cleaning blade, a support member, a toner collection house and a blade support spring. The charging devices for each photoconductor also individually include cleaning foam, which is capable of cleaning toner off of the charge roller surface.

The photoconductors were produced using an anodized and sealed aluminum core, a charge generation layer and a charge transport layer. The charge generation layer on the photoconductors included a pigment which may be dispersed in one or more binders before coating. The charge transport layer may therefore include one or more charge transport molecules and a binder, with and without additives. In the examples which follow, the parts and percentages are by weight for indicated charge generation layer or charge transport layer formulation.

Comparative Example A

Charge Generation Layer

The charge generation formulation used herein includes a mix of phthalocyanine titanium oxide complex (TiOPC) with the ration of type I to type IV of 1 to 2. BX-1/Epon at a 3/2 ratio was used as the binder in the formulation. The formulation include 30.15 g of Type IV TiOPC, 14.85 g of Type I TiOPC, 22.09 g of PVB(BX-1) and 14.71 g of Epon 1001. The dispersion was then milled to a mean particle size of 110-130 nanometers (nm).

Comparative Example B

Charge Transport Layer (35% N,N'-Bis(3-methylphenyl)-N,N'-diphenylbenzidine)

A charge transport formulation was prepared by dissolving N,N'-Bis(3-methylphenyl)-N,N'-diphenylbenzidine (31.5 g) (otherwise known as triphenyldiamine or TPD) and polycarbonate Z-400 (58.5 g, Mitsuibishi Gas Chemical Co., Inc.) in a mixed solvent of tetrahydrofuran and 1,4-dioxane. The charge transport layer was coated on top of the charge generation layer and cured at 110° C. for 1 hour to give a thickness of 26-27 μm.

Example A

The charge generation layer is the same as in comparative Example A. The charge transport layer (35% N, N'-Bis(3-methylphenyl)-N, N'-diphenylbenzidine and 2% boron nitride) was prepared as follows. One dissolves 31.5 g of N,N'-Bis(3-methylphenyl)-N, N'-diphenylbenzidine, 1.8 g of boron nitride (mean particle size D50=2 μm) and 58.5 g polycarbonate Z-400 (Mitsuibishi Gas Chemical Co., Inc.) in a mixed solvent of THF and 1,4-dioxane. The charge transport layer was then coated on top of the charge generation layer and cured at 110° C. for 1 hour to provide a thickness of 26-27 μm.

Example B

The charge generation layer is the same as in comparative Example A. The charge transport layer (35% N, N'-Bis(3-methylphenyl)-N,N'-diphenylbenzidine and 3% boron nitride) was prepared as follows. One dissolves 31.5 g of N,N'-Bis(3-methylphenyl)-N, N'-diphenylbenzidine, 2.7 g of boron nitride (mean particle size D50=2 μm) and 58.5 g polycarbonate Z-400 (Mitsuibishi Gas Chemical Co., Inc.) in a mixed solvent of THF and 1,4-dioxane. The charge transport layer was then coated on top of the charge generation layer and cured at 110° C. for 1 hour to provide a thickness of 26-27 μm.

Example C

The charge generation layer is the same as in comparative Example A. The charge transport layer (35% N, N'-Bis(3-methylphenyl)-N, N'-diphenylbenzidine and 4% boron nitride) was prepared as follows. One dissolves 31.5 g of N,N'-Bis(3-methylphenyl)-N, N'-diphenylbenzidine, 3.62 g of boron nitride (mean particle size D50=2 μm) and 58.5 g polycarbonate Z-400 (Mitsuibishi Gas Chemical Co., Inc.) in a mixed solvent of TFH and 1,4-dioxane. The charge transport layer was then coated on top of the charge generation layer and cured at 110° C. for 1 hour to provide a thickness of 26-27 μm.

The photoelectrical characteristics were then evaluated with what may be described as off-line testing. Specifically, the test may be considered similar to a printer-based system. The components include a charge roll, a relatively high speed electrostatic probe, an erase lamp and a relatively low-power laser. Each of these components may then be set at a distance and location for testing and the testing sequence may be software controlled. The testing proceeds as follows: (1) a negative AC or DC charge is applied to the roll shaft. The charge roll and the photoconductor are in contact and are rotated at relatively constant speed. The interface between the charge roll and photoconductor produces a negative charge voltage on the photoconductor; (2) once the desired charge level is reached on the photoconductor, the laser will be turned on striking the photoconductor, thereby discharging the charge level at a specified location. The electrostatic probe may then measure the discharge level. This step may be considered analogous to the expose to develop time for a given photoconductor. The rotational speed of the photoconductor typically remains constant. In order to simulate a particular printer speed, the distance between the laser and the electrostatic probe may be adjusted. A relatively short distance may simulate a relatively fast printer and a wider distance may simulate a relatively slow printer; (3) once the discharge voltage is recorded, the erase lamp can neutralize the remaining amount of voltage on the photoconductor; (4) measurements may be recorded at various laser powers. The result is, as alluded to above, a curve known as discharge voltage (V) versus energy level (E).

The above referenced samples were then formed into photoconductors drums for the off-line testing noted above. Cycling fatigue was measured by repeating the charge-discharge cycle 1000 times. Photo-induced discharge and dark decay were taken before and after 1000 cycles. Table 1 provides the initial electrical data and the fatigue electrical data listed in the Table 2 below represents the change after 1000 cycles.

TABLE 1

| Initial Electricals | | | | |
|---|---|---|---|---|
| Drums | V@0.12 μJ | V@0.33 μJ | V@0.70 μJ | Dark Decay (1 Sec) |
| Comparative Example A | −223.1 | −79 | −54.7 | 20.8 |
| 35% TPD PCZ-300 with 2% BN | −250.4 | −94 | −57.6 | 20.6 |
| 35% TPD PCZ-300 with 2% BN | −234.9 | −95 | −63.8 | 27.6 |
| 35% TPD PCZ-300 with 2% BN | −250.0 | −105 | −68.2 | 20.5 |

TABLE 2

| Fatigue Electricals | | | | |
|---|---|---|---|---|
| Drums | V@0.12 μJ | V@0.33 μJ | V@0.70 μJ | Dark Decay (1 Sec) |
| Comparative Example A | +11 | −5 | −6 | 27.5 |
| 35% TPD PCZ-300 with 2% BN | +13 | +1 | −2 | 26.9 |
| 35% TPD PCZ-300 with 2% BN | +9 | −4 | −6 | 23.4 |

TABLE 2-continued

| Fatigue Electricals | | | | |
|---|---|---|---|---|
| Drums | V@0.12 μJ | V@0.33 μJ | V@0.70 μJ | Dark Decay (1 Sec) |
| 35% TPD PCZ-300 with 2% BN | +11 | +5 | 0 | 22.5 |

Figure 4:
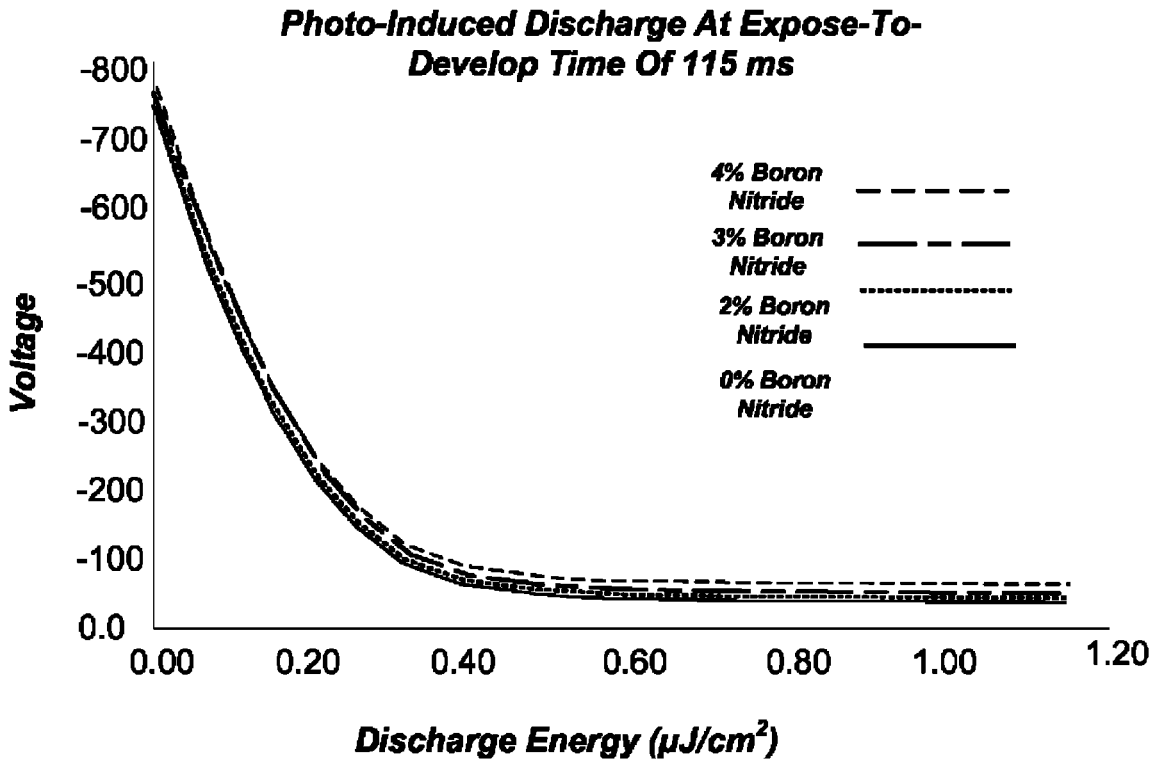
FIG. 4 is a graph of photo-induced discharge potential (V) versus discharge energy (uJ/cm$^2$).

FIG. 4 next illustrates the photo-induced charge discharge curves of comparative example A (0% BN) and examples A-C (2% BN, 3% BN and 4% BN). As can now be seen from Tables 1 and 2 and FIG. 4, the level of boron nitride appears to have little effect on the characteristics of PID of the photoconductor and its capability to hold a charge in the dark. Again, as noted above, the residual potential at 0.7 uJ/cm$^2$ for the photoconductor containing boron nitride in the charge transport layer may be within +/−15% or less of the residual potential of the photoconductor in the absence of boron nitride.

In addition, visual assessment was next made of the photoconductor and print quality. The test were run in a controlled environment (80% relative humidity at 78° F.) in a 15-35 page-per-minute (PPM) printer with toner cartridges containing the toner particles noted above (i.e. size range of 1-25 μm and average degree of circularity of 0.90-1.0). The run procedure was 2 page/pause (20 seconds) at 600 and 1200 dpi print quality. Print quality was run over 10,000 pages and a cold print quality sample was taken at 3,000 and 6,000 pages. Reference to a cold print quality sample is reference to the step of allowing the printed to cool overnight and running the print quality sample for evaluation.

The filming defects typically show in the cold print samples and primarily at 1200 dpi. The following was the film rating used herein: 0=no filming; 1=slight filming in print; 2=objectionable filming in print, small areas; 3=objectionable filming across print; 4=gross filming, blurry image. From testing of 46 drums containing boron nitride and 50 controls (0% BN) the statistical data indicated that the addition of boron nitride in the charge transport layer improved filming resistance. The average film rating for the controls was 1.74 while for the drum with boron nitride the average film rating was 0.74.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A printer cartridge comprising:

a photoconductor comprising a support structure, a charge generation layer disposed at least partially over said support structure and a charge transport layer;

boron nitride dispersed in said charge transport layer, wherein said boron nitride:

(a) has an aspect ratio ranging from 5-30;

(b) a D50 mean particle size of less than about 10.0 μm;

(c) is present at about 5.0% (wt) or less in said charge transport layer;

(d) provides a dark decay ($DD_{BN}$) that is equal to about (0.7−1.3)(DD), wherein DD represents the dark decay of said photoconductive element in the absence of boron nitride; and (e) provides a photoinduced decay residual potential at 0.7 uJ/cm$^2$ that is within about +/−15% of the residual potential of said photoconductor in the absence of boron nitride; and toner particles wherein said toner particles have a size range of about 1-25 μm and an average degree of circularity of about 0.90-1.0.

2. The cartridge of claim 1 wherein said boron nitride has a D50 mean particle size of greater than 1.0 μm to about 8.0 μm.

3. The cartridge of claim 1 wherein said boron nitride is present at about 0.1 to about 5.0% (wt.).

4. The cartridge of claim 1 wherein said charge transport layer includes a polycarbonate binder and an aryl amine compound.

5. The cartridge of claim 1 wherein said photoconductor is located in a cartridge for an image forming device.

6. The cartridge of claim 1 wherein said charge transport layer comprises a binder and an aryl amine compound.

7. The cartridge of claim 6 wherein said aryl amine compound comprises N,N'-bis(3-methylphenyl)-N,N'-diphenylbenzidine.

8. The cartridge of claim 1 wherein said charge transport layer has a thickness of up to about 35 microns.

9. The cartridge of claim 1 wherein said cartridge is located in an image forming device.

10. A printer cartridge comprising:

a photoconductor comprising a support structure, a charge generation layer disposed at least partially over said support structure and a charge transport layer containing a polycarbonate binder and an aryl amine compound wherein said charge transport layer is present at a thickness of about 20-30 microns;

boron nitride dispersed in said charge transport layer, wherein said boron nitride:

(a) has an aspect ratio ranging from 5-30;

(b) a D50 mean particle size of less than about 8.0 μm;

(c) is present at about 5.0% (wt) or less in said charge transport layer;

(d) provides a dark decay ($DD_{BN}$) that is equal to about (0.7−1.3)(DD), wherein DD represents the dark decay of said photoconductive element in the absence of boron nitride; and (e) provides a photoinduced decay residual potential at 0.7 uJ/cm$^2$ that is within about +/−15% of the residual potential of said photoconductor in the absence of boron nitride; and toner particles wherein said toner particles have a size range of about 1-25 μm and an average degree of circularity of about 0.90-1.0.

11. The printer cartridge of claim 10 wherein said aryl amine compound comprises N,N'-bis(3-methylphenyl)-N,N'-diphenylbenzidine.

12. The printer cartridge of claim 10 wherein said cartridge is located in an image forming device.

13. A method for forming a photoconductor containing a support structure, a charge generation layer and a charge transport layer comprising:

combining a binder and a charge generation compound and coating a portion of the support structure and forming a charge generation layer having a thickness of less than or equal to about 5.0 microns;

combining a binder and a charge transport compound and boron nitride and coating a portion of the charge generation layer to form a charge transport layer at a thickness of less than or equal to about 35 microns, wherein said boron nitride has (a) has an aspect ratio of greater than 1.0;

(b) a D50 mean particle size of less than about 10.0.um; and (c) is present at about 5.0% (wt) or less in said charge transport composition;

wherein said photoconductor containing boron nitride when used in an electrophotographic printer provides:

(i) a dark decay ($DD_{BN}$) that is equal to about (0.7–1.3) (DD), wherein DD represents the dark decay of said photoconductor in the absence of boron nitride; and (ii) a photoinduced decay residual potential at 0.7 uJ/cm$^2$ that is within about +/−15% of the residual potential of said photoconductor in the absence of boron nitride.

14. The method of claim 13 wherein said charge transport compound comprises an aryl amine compound.

15. The method of claim 13 wherein said charge transport layer has a thickness of about 20-30 microns.

16. The method of claim 13 wherein said boron nitride is present at about 0.1 to about 5.0% (wt.).

17. The method of claim 13 including positioning said photoconductor in an image forming device.

* * * * *